United States Patent [19]

Sawai et al.

[11] 4,254,201

[45] Mar. 3, 1981

[54] PRESSURE SENSITIVE ADHESIVE TONER OF CLUSTERED ENCAPSULATED POROUS PARTICLES FOR USE IN ELECTROSTATIC PHOTOGRAPHY

[75] Inventors: Yuji Sawai; Hisayuki Ushiyama, both of Tokyo, Japan; Tsuiki, deceased Harunobu, late of Tokyo, Japan; by Noriko Tsuiki, a legal representative, Chigasaki, Japan; Tomohiro Tsuiki, legal representive, Chigasaki, Japan; Manami Tsuiki, legal representive, Chigasaki, Japan; Tadashi Fujii, Tokyo, Japan; Eiichi Akutsu, Tokyo, Japan; Itsuo Ikeda, Tokyo, Japan

[73] Assignee: Ricoh Company, Ltd., Tokyo, Japan

[21] Appl. No.: 34,194

[22] Filed: Apr. 27, 1979

Related U.S. Application Data

[63] Continuation-in-part of Ser. No. 841,398, Oct. 12, 1977, abandoned.

[30] Foreign Application Priority Data

Oct. 15, 1976 [JP] Japan ..... 51-123573

[51] Int. Cl.[3] ..... G03G 9/08

[52] U.S. Cl. ..... 430/111; 430/107; 430/109; 430/98; 430/114; 430/138; 252/316; 428/403

[58] Field of Search ..... 430/111, 109, 113, 98, 430/114, 138; 252/316; 428/403

[56] References Cited

U.S. PATENT DOCUMENTS 3,326,848 6/1967 Clemens et al. ..... 430/109

*Primary Examiner*—John D. Welsh

*Attorney, Agent, or Firm*—Blanchard, Flynn, Thiel, Boutell & Tanis

[57] ABSTRACT

A pressure sensitive adhesive toner for use in electrostatic photography which consists essentially of porous aggregates. Each aggregate consists essentially of a cluster of a multiplicity of individual granules of pressure sensitive adhesive substance, each granule being encapsulated by a coating film of a film-forming material. Particles of an inorganic or organic pigment and/or a magnetic substance are contained within the aggregate in the interstices between the granules and deposited on the surfaces of the encapsulated granules. The toner aggregates are free from a tendency to cohere, cake and agglomerate to each other. The toner can be readily pressure fixed, using a low impression pressure, onto a surface bearing an electrostatic latent image without causing any contamination thereon, thereby forming a distinct visible image.

11 Claims, 1 Drawing Figure

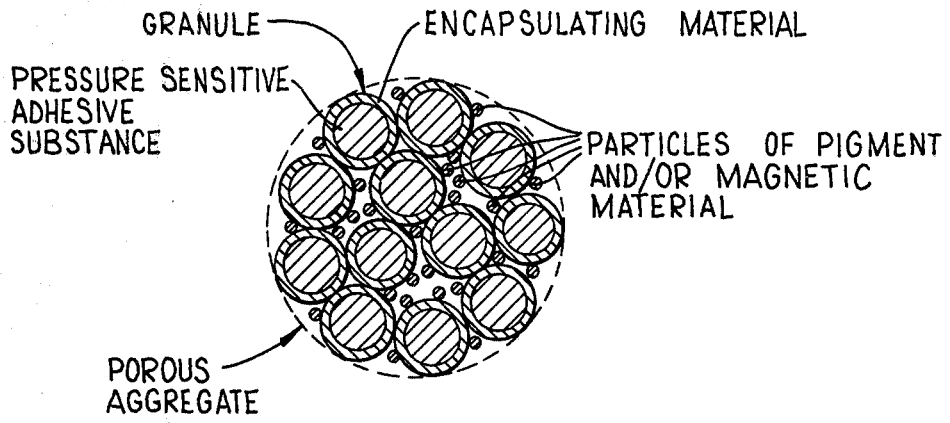
GRANULE
ENCAPSULATING MATERIAL
PRESSURE SENSITIVE ADHESIVE SUBSTANCE
PARTICLES OF PIGMENT AND/OR MAGNETIC MATERIAL
POROUS AGGREGATE

PRESSURE SENSITIVE ADHESIVE TONER OF CLUSTERED ENCAPSULATED POROUS PARTICLES FOR USE IN ELECTROSTATIC PHOTOGRAPHY

BACKGROUND OF THE INVENTION (a) Field of the Invention

The present invention relates to a toner for use in electrostatic photography, and more specifically relates to a pressure sensitive adhesive toner for use in electrostatic photography which is capable of readily being fixed to a surface by applying pressure to the toner.

(b) Background of the Invention

Heat fixable toners have been mainly used in electrostatic photography. Heat fixable toners are mainly composed of a thermoplastic resin, and they are prepared by the steps comprising softening said resin by heating, admixing a coloring agent therewith and then grinding same. In use, these toners are melted by the use of heating means such as heating rolls, infrared radiation or the like, and then they are fixed to form a visible image. However, the conventional fixation methods using thermofixable toners have involved the various problems enumerated hereunder;

(1) A long period of time is required for raising the temperature within the fixation apparatus to a temperature higher than the softening temperature of the toner used, (2) A large amount of electric power is required for maintaining the temperature within the fixation apparatus higher than the softening temperature of the toner used, (3) The use of an excessively high temperature within the fixation apparatus in order to increase the copying speed is liable to cause scorched copies to be produced and in an extreme situation, to cause a fire.

Proposals have been made to increase the copying speed while maintaining the temperature within the fixation apparatus at a low level by using toners which have a low softening point or which can be fixed merely by applying pressure thereto. For instance, Japanese Pat. Publication No. 9880/1969 discloses a pressure fixable toner composition comprising $C_6$–$C_{25}$ aliphatic components, and Japanese Pat. Open Application Nos. 75033/1973, 78931/1973 and 78936/1973 disclose developers for use in electrostatic photography comprising soft polymers, respectively. However, preparation of these developers by means of conventional grinding methods is accompanied by a higher cost of preparation on account of (1) the necessity of cooling and grinding said composition or soft polymers at temperatures under their brittle points from the viewpoint of grindability and (2) the necessity of classifying the thus prepared toners, which have a wide particle size distribution, according to their particle sizes. Moreover, these toners are disadvantageous in the following points, (3) cohesion, bridging and caking take place during the preparation or storage of the toners, (4) adhesion occurs between the carrier particles and the toners, (5) the urface of the electrostatic latent image becomes coated with a film stain, which causes trouble in repetitive use.

Additionally, Japanese Pat. Publication No. 8561/1959 and U.S. Pat. No. 3,080,318 disclose pressure recording of encapsulated oily coloring agents. U.S. Pat. No. 3,080,250, U.S. Pat. No. 3,386,822 and Japanese Pat. Open Application No. 71648/1973 disclose methods of imparting fixability of toners by breaking solvent-containing capsules and so forth. However, the aforesaid prior art is not free from drawbacks such as, because the encapsulated core materials are liquid the images formed by using these toners are liable to be blurred and to exhibit flowing and to possess the foul odor of the solvents. Still further, Japanese Pat. Open Application No. 75032/1973 and Japanese Patent Open Application No. 17739/1974 disclose soft polymer-encapsulated pressure fixable toners. In these cases, large quantities of organic solvents are also used in the preparation of said toners, resulting in an increased cost owing to the recovery of solvents and so forth, the necessity of selecting non-combustible solvents from the viewpoint of fire prevention and the inevitable restriction in selecting the resins to be used. These toners, which are inferior in particle fluidity, are admixed with hydrophobic silica, etc., as a flow agent. Since these additives impede the toner's fixability, there is required a high pressure of 300–400 lb/in for the purpose of fixing the toner powder images. The prior toners are not fully satisfactory from the practical point of view.

SUMMARY OF THE INVENTION

A primary object of the present invention is to provide a practical and inexpensive pressure sensitive adhesive toner for use in electrostatic photography, which toner is capable of eliminating the aforesaid drawbacks and which achieves a good fixing using a reduced impression pressure and which forms images having a high fixing strength.

Another object of the present invention is to provide a pressure sensitive adhesive toner for use in electrostatic photography which is free from such troubles as cohesion, caking and so forth and which does not cause any staining of the surface of an electrostatic latent image.

A still further object of the present invention is to provide a pressure sensitive adhesive toner for use in electrostatic photography which toner is capable of forming a distinct image free from solvent odor and the phenomena of "blurring" and "flowing".

The toner according to the present invention comprises porous aggregates consisting principally of a pressure sensitive adhesive substance, an inorganic or organic pigment and/or a magnetic substance.

Conventional pressure fixable toners, as mentioned above, must be pressed with an extremely high pressure for fixing purposes. This is because conventional toners employ a fixing mechanism wherein plastic deformation of the toner particles is utilized.

In contrast, the toner according to the present invention employs a fixing mechanism wherein deformation or destruction of porous aggregates is utilized, whereby the pressure needed to effect fixing can be reduced and the fixing strength can be increased.

It is known that the breaking strength of porous aggregates consisting essentially of clusters of granules varies widely depending on the granule size, the gaps between the granules, the bonding strength of the granules, etc., in particular, the porosity of the porous aggregates.

The toner according to the present invention utilizes a fixing mechanism which comprises deformation or destruction of the aforesaid porous aggregates. The fixing mechanism in this case is considered to be advantageous in the following points:

(1) the porous aggregates employed herein can readily be broken so that fixation of the toner can be effected by impressing a low pressure thereon, (2) the porous aggregates, when impressed with the fixing pressure, are broken or deformed thereby to narrow the gaps between the individual solid particles of pigment and/or magnetic substance, (3) the pressure sensitive adhesive substance, which is solid at room temperature, is inherently adhesive and becomes flowable upon impression of pressure thereon, and therefore after it has been impressed with the fixing pressure, it flows into the gaps between the solid particles thereby to narrow said gaps further, and (4) when the impressed pressure is released, the pressure sensitive adhesive substance, which has flowed into the gaps between the solid particles of pigment and/or magnetic substance, is restored to its previous solid state so that it serves not only to narrow the gaps between the particles, but also simultaneously to increase the bond strength between the particles, that is, the breaking strength of the particles, thereby enhancing the fixing strength of the image.

As a method of preparing a toner comprising porous aggregates, according to the present invention, there is suitably employed in the present invention, for example, a granulation method which comprises uniformly dispersing a mixture consisting of an emulsion or a suspension of a pressure sensitive adhesive substance, pigment and/or particles of a magnetic substance, and if needed, a small quantity of an additive such as a bonding agent, emulsifier or dispersing agent or the like, spray-drying the thus prepared dispersion and then granulating the spray-dried particles. But, any method of granulating said mixture by virtue of a capillary action between the particles without using a bonding agent, a method of granulating same by virtue of the bonding strength of a bonding agent or the like, a compression molding method in which granulation is effected by impressing pressure on the powdery particles and the like is useful in the present invention.

The term "pressure sensitive adhesive substance" used herein means a substance which, when pressure is impressed thereon, is reduced in viscosity or flows, and, conversely, when the impressed pressure is released, it increases in viscosity or returns to the solid state. The pressure sensitive adhesive substances preferably have a modulus of elasticity of less than $10^{10}$ dyne/cm$^2$ and a blocking-initiating temperature of less than 50° C. Examples of pressure sensitive adhesive substances will be enumerated below.

Tacky substances (1) Acrylic type and vinyl type copolymers copolymer of at least one monomer selected from each of the following monomer groups (A) and (B) or copolymer of at least one monomer selected from each of the following monomer groups (A), (B) and (C).

(A) Monomer capable of forming copolymers having a comparatively low glass transition temperature Tg: ethyl, butyl, isoamyl and 2-ethylhexyl esters of acrylic acid; ethyl, butyl, isoamyl, 2-ethylhexyl and lauryl esters of methacrylic acid; dioctyl maleate; dioctyl fumarate.

(B) Monomers capable of forming polymers having a comparatively high glass transition temperature Tg: methyl acrylate, methyl methacrylate, acrylonitrile, styrene, vinyl acetate, vinyl propionate.

(C) Monomers having a functional radical: acrylic acid, methacrylic acid, hydroxyethyl methacrylate, hydroxypropyl methacrylate, methylol acrylamide, acrylamide, dimethylaminomethyl methacrylate, diethylaminoethyl methacrylate, glycidyl methacrylate, itaconic acid.

(2) isobutylene rubber, polybutene, butadiene rubber, nitrile rubber, natural rubber, chlorinated rubber, etc., and copolymers and graft copolymers of said rubbers and acrylic type monomers copolymerizable with said rubbers.

Tackifiers (1) Meso-polymer resins rosin, dammar, copal, hydrogenated rosin, rosin ester, indene resin, cumarone resin, olefin type resin, polyterpene, alkyd resin, etc.

(2) Plasticizers dioctyl phthalate, dibutyl phthalate, chlorinated paraffin, etc.

(3) Waxy substances higher fatty acids such as stearic acid, palmitic acid, myristic acid, lauric acid, etc.; higher fatty acid salts such as aluminum stearate, potassium stearate, zinc palmitate, etc.; derivatives of higher fatty acids such as hydrogenated castor oil, cocoa butter, methylhydroxy stearate, glycerolmonohydroxy stearate, etc.; waxes such as Japan wax, beeswax, carnauba wax, microcrystalline wax, paraffin wax, etc.; those having a low molecular weight and made of polyolefins and copolymers thereof such as polyethylene, ethylene-vinyl acetate copolymer, ethylene-vinyl alkyl ether copolymer, etc.

Other pressure sensitive adhesive substances (1) Condensation polymers epoxy modified phenol resin, natural resin modified phenol resin, amino resin, silicone resin, polyurethane, urea resin, polyester, etc. (2) Petroleum type residue asphalt, gilsonite, etc.

In addition, the following additives can be used in the toner, according to the present invention, as an emulsifier or a dispersant having a plasticizing effect.

derivatives of oleic acid such as butyl oleate, tetrahydrofurfuryl oleate, glyceryl monooleate, ethylene glycol monooleate, etc.; derivatives of ricinoleic acid such as methyl acetyl ricinoleate, butyl acetyl ricinoleate, glyceryl monoricinoleate, diethylene glycol monoricinoleate, glyceryl triacetyl ricinoleate, etc.; derivatives of stearic acid such as n-butyl stearate, glyceryl monostearate, diethylene glycol distearate, etc.; diethylene glycol monolaurate; fatty acid ester-type secondary plasticizers such as diethylene glycol dipelargonate, triethylene glycol pelargonate, pentaerythritol fatty acid ester, octyl fatty acid ester, polyhydric alcohol fatty acid ester, etc.

Further, the following inorganic or organic pigments can be used, namely, black pigments such as aniline black, carbon black, acetylene black, lamp black, etc.; white pigments such as zinc oxide, titanium oxide, zinc sulfide, etc.; red pigments such as Brilliant Carmine 6B, Rhodamine B, Permanent Red, Wachtung Red, etc.; blue pigments such as Phthalocyanine Blue, Cobalt Blue, Fast Sky Blue, Prussian Blue, etc.; yellow pigments such as Benzidine Yellow, Hansa Yellow, Naphthol Yellow, Cadmium Yellow, etc.; inorganic extenders such as clay, silica, talc, alumina white, etc.; and organic extenders such as polyethylene, polystyrene, polyvinyl chloride, fluorine resin, cellulose, etc.

Further, the magnetic substances can be a powder of tri-iron tetroxide, nickel, cobalt, iron, etc.

The aforesaid pigments and magnetic substances can be used singly or in the form of mixtures of two or more of them, respectively.

The ratio of the pressure sensitive adhesive substance to the pigment and/or magnetic substance is preferred to be from about 1/20 to 20/1 parts by weight.

In the present invention at least one member of the aforesaid group of the pressure sensitive adhesive substances is used in the form of granules when the substance inherently is of granular form or, if necessary, in the form of granules obtained by the emulsification or dispersion thereof by using an emulsifier or dispersing agent. In view of the fact that particles of these pressure sensitive adhesive substances are liable to cohere to each other, furthermore, they can be used in an encapsulated state for the purpose of preventing such cohesion. The encapsulating operation in this case can be effected by conventional methods for encapsulating pressure sensitive adhesive substances, for instance, the complex coacervation method; the simple coacervation method; the coacervation method which comprises dissolving a polymer in an aqueous solution, rendering the polymer insoluble by varying the pH and the temperature of and removing a solvent from said aqueous solution and then separating the polymer therefrom; interfacial polycondensation; in situ polymerization; methods of encapsulating hydrophobic substances in an aqueous solvent such as a submerged drying method and so forth. The encapsulating materials used herein preferably have a blocking-initiating temperature above 50° C. The encapsulating materials that meet such a requirement include gum arabic, gelatin, albumin, sodium alginate, carboxymethyl cellulose, hydroxyethyl cellulose, ethylene-sodium maleate anhydride copolymer, vinyl methyl ether-maleic anhydride (or ester thereof) copolymer, styrene-acrylic acid-butyl methacrylate copolymer, urea-formaldehyde polycondensate, polyester, polyamide, and so forth.

As described above, if necessary, a binder can be added to the toner according to the present invention. These binders can be any substance capable of forming a film when granulated, such as styrene-butadiene copolymer, carboxy modified styrene-butadiene copolymer, acrylonitrile-butadiene copolymer, carboxy modified acrylonitrile-butadiene copolymer, methylmethacrylate-butadiene copolymer, carboxy modified methylmethacrylate-butadiene copolymer, acrylic acid ester type copolymer, methacrylic acid ester type copolymer, ethylene-vinyl-acetate copolymer, ethylene-vinyl alkyl ether copolymer, etc. These binders can be used in the form of an emulsion or latex.

The thus obtained toner, as described above, has the form of porous aggregates wherein the porosity of the individual aggregates is about 5 to 50%, the true specific gravity of the aggregates is about 0.9 to 2.9 and the mean diameter of the aggregates is about 5 to 30 microns. The porosity is calculated from the following formula, $$\text{Porosity } (\%) = (1 - P/Po) \times 100(\%)$$

wherein P is the apparent density of the toner aggregates which value is determined using liquid paraffin and a picnometer and Po indicates the true specific gravity thereof which value is determined by means of a Bechman air comparison type hydrometer made by TOSHIBA Co., LTD.

The thus obtained porous aggregates of the present invention preferably have a size of about 5 to 30 microns.

BRIEF DESCRIPTION OF THE DRAWING

The drawing is a cross-sectional view of a single porous aggregate according to the invention.

As shown in the drawing, the individual porous aggregates of the toner consist essentially of a multiplicity of individual granules of pressure sensitive adhesive substance encapsulated by a relatively thin frangible coating film of the encapsulating material. The particles of pigment and/or magnetic substance are randomly dispersed in the spaces between the granules. If desired, a binder (not shown) can be incorporated, together with the particles of pigment and/or magnetic substance, in the spaces between the granules. The granules adhere to each other where they contact each other owing to adhesion that occurs between the encapsulating films during spray-drying. The particles of pigment and/or magnetic substance likewise adhere to the encapsulating films of the granules so that the porous aggregates are unitary and shape-retaining, but are crushable by a relatively low fixing pressure. The binder, when used, will improve the adhesion between the granules and between the particles and the granules. The individual porous aggregates, as a whole, are approximately spherical in shape with a rough surface, like an orange. The toner, as a whole, consists of a multitude of porous aggregates as described above. Because the encapsulating films of the granules of the porous aggregates are frangible, when the appropriate fixing pressure is applied to the toner, the porous aggregates will be broken apart into separate granules and the encapsulating films on the individual granules also will be broken and therby the pressure sensitive adhesive substance in the granules will be released. The pressure sensitive adhesive substance is rendered flowable by the fixing pressure and it flows to form an adhesive film which adheres to the electrostatic latent image on the substrate and also adheres to the pigment and/or magnetic particles. When the fixing pressure is released, the pressure sensitive adhesive substance will solidify. In this manner, a high quality visible image is formed on the substrate.

Illustrative examples of the preparation of toners of the present invention are set forth hereinafter.

(1) Pressure sensitive adhesive substances (as core materials) are first each encapsulated in an encapsulating material, the resulting capsules are mixed and the mixture is bonded by a binder containing dispersed therein magnetic particles and/or coloring agents, and (2) A mixture of pressure sensitive adhesive substances is encapsulated in an encapsulating material and thereafter same is bonded by a binder containing dispersed therein magnetic particles and/or coloring agents. Preferred embodiments of the invention.

EXAMPLE 1

| | |
|---|---|
| Dispersion of microcrystalline wax (NOPCO 1245M produced by SAN NOPCO Co., U.S.A., solid content 45%) | 200 g |
| Carbon black (Colloidex No. 5 produced by COLUMBIA CARBON Co., U.S.A.) | 11 g |
| Latex of carboxy modified styrene - butadiene copolymer (JSRO 590 produced by NIPPON GOSEI GOMU Co., Ltd., solid content 45%) | 40 g |

The above composition was dispersed uniformly by means of a homomixer, and the resulting dispersion was spray dried by means of a NIRO atomizer under the following spray-drying conditions: inlet temperature 120° C., outlet temperature 85° C., and spraying pressure 6 Kg/cm$^2$, thereby to obtain a toner having a mean particle diameter of 9.4 microns.

From a scanning type microphotograph of this toner, it was observed that the toner particles had a globular shape, a summer orange peel-like unevenness and a particle diameter substantially corresponding to that of the NOPCO 1245 M used, and it was comprised of porous aggregates with innumerable small pores thought to have been formed by the evaporation of the dispersion medium therefrom during spray-drying. Next, an electrostatic latent image formed on a commercially available electrophotographic sensitive paper was developed using this toner, and then the paper was passed between steel rollers and was impressed with a linear pressure of 2 Kg/mm for fixing purposes. When this fixed image was examined by a microscope, it was observed that the pressure sensitive adhesive particles were so uniformly leveled owing to rearrangement and deformation that a boundary line between adjacent toner particles could hardly be observed. This fixed image was subjected to a delamination test using adhesive tape. It was found that its fixing strength was strong and the toner could not be delaminated.

EXAMPLE 2

| | |
|---|---|
| Emulsion of polybutene (NISSEKI POLYBUTENE He-350 produced by NIPPON SEKIYU Co., Ltd., solid content 50%) | 150 g |
| Tri-iron tetroxide (M-32 produced by TODA KOGYO Co., Ltd.) | 250 g |
| Dispersion of polystyrene (PLASTIC PIGMENT 788 or 722 produced DOW CHEMICAL Co., U.S.A., solid content 48.5%) | 206.2 g |
| Latex of carboxy modified methyl methacrylate - butadiene copolymer (Krosren 2M-38 produced TAKEDA YAKUHIN KOGYO Co., Ltd., solid content 45%) | 55.5 |

The above composition was subjected to spray-drying under the same conditions as described in Example 1 to obtain a magnetic substance-containing toner having a mean particle size of 17.2 microns. The thus obtained toner was impressed with a linear pressure of 1.5 Kg/mm to form a strongly fixed image.

EXAMPLE 3

| | |
|---|---|
| Emulsion of petroleum resin (Serozol A-399 produced by CHYUKYO YUSHI Co., Ltd., solid content 50%) | 150 g |
| Tri-iron tetroxide (M-32 produced by TODA KOGYO Co., Ltd.) | 260 g |
| Carbon black (MITSUBISHI COLOR CARBON #44 produced by MITSUBISHI KASEI Co., Ltd.) | 5.2 g |
| Emulsion of polyacrylic acid ester type synthetic resin (ULTRA SOL 2322 produced by TAKEDA KAGAKU Co., Ltd., solid content 40%) | 75 g |

The above composition was spray dried under the same conditions as described in Example 1 to obtain a magnetic substance-containing toner. The thus obtained toner was impressed with a linear pressure of 2 Kg/mm to form a strongly fixed image.

EXAMPLE 4

A toner was prepared in accordance with the same procedure as described in Example 1 except that 300 grams of carnauba wax dispersion (Serozol #524 produced by CHYUKYO YUSKI, solid content 30%) were employed in lieu of 200 grams of NOPCO 1245 M. The thus prepared toner exhibited the same superior results as in Example 1.

EXAMPLE 5

A toner was prepared in accordance with the same procedure as described in Example 3 except that 150 grams of natural rubber-acrylic acid ester graft copolymer emulsion (Resitex SP-17 produced by NANYO KASEI Co., Ltd., solid content 55%) were employed in lieu of 150 grams of petroleum resin emulsion. The thus prepared toner exhibited the same superior results as in Example 3.

EXAMPLE 6

A toner was prepared in accordance with the same procedure as described in Example 3 except that said polyacrylic acid ester-type synthetic resin emulsion was not used. The thus prepared toner exhibited the same superior results as in Example 3.

EXAMPLE 7

An acrylic type adhesive (Nicazol TS-444 produced by NIPPON CARBIDE Co., Ltd., solid content 60%) was encapsulated in gelatin and gum arabic by a complex coacervation encapsulating method so that the ratio of core material to wall material was 7.5:1.0, whereby a dispersion of encapsulated adhesive was obtained. Next, 270 grams of said encapsulated adhesive dispersion (capsule concentration 37%), 26 grams of carbon black (which had been prepared by dispersing MITSUBISHI CARBON #44 in a ball mill beforehand so that the solid content was 20%), 200 grams of tri-iron tetroxide, 20 grams of polystyrene dispersion (PLASTIC PIGMENT 722) and 50 grams of ULTRA SOL 2322 were mixed uniformly by means of a stirrer, and then subjected to spray-drying by using a NIRO atomizer under the spray-drying conditions: inlet temperature 120° C., outlet temperature 90° C. and spray pressure 5.6 Kg/cm$^2$, thereby to obtain a magnetic substance-containing toner having a mean particle diameter of 20.0 microns. The thus obtained toner was impressed with a linear pressure of 1.2 Kg/mm to thus form a strongly fixed image.

EXAMPLE 8

One hundred grams each of aqueous solutions of 5% by weight gum arabic and 5% by weight gelatin were mixed, 100 grams of a microcrystalline wax dispersion having a mean particle diameter of 3 mi crons (1245 M produced by SAN NOPCO Co., U.S.A., solid content: 45%) were added to said mixture while regu lating its pH to 10 and maintaining its temperature at 50° C., the pH of the mixture was gradually lowered to 4.4 with acetic acid to thereby encapsulate said microcrystalline wax particles in a gelatin-gum arabic encapsulating film, the whole system was cooled to a temperature of 5° to 10° C., and thereafter 3 grams of 37% by weight formaldehyde aqueous solution were added thereto to solidify said encapsulating film.

Separately, a dispersion was prepared by dispersing 3 grams of carbon black (COLLOIDEX No. 5 produced by COLUMBIA CARBON CO.), and 25 grams of magnetic iron powder (M-32 produced by TODA KOGYO Co.) in 35 grams of polystyrene latex (DOW 201 produced by DOW CHEMICAL Co., U.S.A.). The dispersion was mixed with said encapsulated adhesive liquid and was dispersed uniformly thereby to obtain a slurry. Finally, this slurry was subjected to spray-drying using a NIRO atomizer under the spray-drying conditions: inlet temperature 135° C., outlet temperature 85° C. and spray pressure 6 Kg/cm$^2$, thereby to obtain a pressure sensitive adhesive, magnetic, microcapsule-type toner comprising clusters of microcrystalline wax particles.

EXAMPLE 9

An encapsulated pressure sensitive adhesive toner was obtained according to the procedure described in Example 8, but wherein said microcrystalline wax (NOPCO 1245M) was replaced by Serozol #967 and said magnetic iron powder was replaced by super-microcrystalline powder of iron - nickel alloy.

EXAMPLE 10

A urea - formaldehyde initial condensate was prepared by the steps of adding 25 grams of urea to 70 grams of 37% formaldehyde aqueous solution, regulating the pH of said mixture to 7.5 with an aqueous solution containing 10% by weight of ethanolamine, and then stirring same while maintaining its temperature at 70° C. This condensate was diluted with water into a 5% aqueous solution. This aqueous solution was admixed with a pressure sensitive adhesive substance, i.e., 200 grams of olefinic resin dispersion (Picopale Emulsion produced by ESSO STANDARD OIL Co., Ltd., solid content: 50%), the pH of said mixture was lowered to 3.5 by the addition of citric acid, and same was stirred while maintaining its temperature in the range of 48±2° C., thereby encapsulating the Picopale particles in a urea-formaldehyde resin film.

Separately, a dispersion was prepared by dispersing 10 grams of magnetic iron powder in 16 grams of polyvinyl acetate latex (A-522 manufactured by DAISERU CO., solid content: 50%). This dispersion was uniformly admixed with said liquid containing encapsulated adhesive to obtain a slurry and then this slurry was subjected to spray-drying by means of a spray drier thereby to obtain a magnetic, pressure sensitive adhesive toner comprising clusters of microcapsules of said adhesive.

EXAMPLE 11

A mixed system of 70 parts by weight of 2-ethylhexyl acrylate, 28 parts by weight of vinyl acetate, 2 parts by weight of acrylic acid and 5 parts by weight of methyl ricinoleate was copolymerized by emulsion polymerization to obtain an emulsion of adhesive substance in which the solid content was 50% by weight. Next, 100 grams of this emulsion were added to 200 grams of mixed aqueous solution containing 5% by weight of gum arabic and 5% by weight of gelatin thereby to encapsulate the adhesive particles by the complex coacervation method.

Separately, a dispersion was prepared of 50 parts by weight of synthetic resin emulsion consisting mainly of polystyrene (DOW 201, a product of DOW CHEMICAL CO., solid content: 50%), 120 parts by weight of magnetic powder M-32 (a product of TODA KOGYO Co.) and 5 parts by weight of carbon black (Colloidex No. 5 produced by COMUMBIA CARBON Co.), this dispersion was uniformly admixed with said liquid containing encapsulated adhesive, and finally said mixture was subjected to spray-drying by means of a NIRO atomizer thereby to obtain a pressure sensitive adhesive toner for use in electrostatic photography wherein encapsulated adhesive and magnetic powder were bound together in the form of porous aggregates.

EXAMPLE 12

A pressure sensitive adhesive toner for use in electrostatic photography was obtained according to the same procedure as described in Example 11, except that the mixed system that underwent emulsion polymerization consisted of 130 parts by weight of the adhesive substance, i.e., 2-ethylhexyl acrylate, 60 parts by weight of vinyl propionate and 10 parts by weight of acrylic acid.

EXAMPLE 13

A pressure sensitive adhesive toner was obtained according to the same procedure as described in Example 12, except that as said adhesive substance there was employed an acrylic type adhesive substance Emulsion MG-1399 (produced by NIPPON CARBIDE CO., Ltd., solid content: about 60%).

EXAMPLE 14

A pressure sensitive adhesive toner was obtained according to the procedure of Example 12, except that as the adhesive substance there was employed a polybutene emulsion HE-350 (produced by NIPPON SEKIYU CO., solid content: 50%).

EXAMPLE 15

A pressure sensitive adhesive toner was obtained according to the same procedure as described in Example 12, except that a natural rubber-acrylic monomer graft copolymer emulsion (Regitex SP-17, produced by NANYO KASEI Co., solid content: 50%) was employed as the adhesive substance and the magnetic particles were omitted.

EXAMPLE 16

A toner was prepared according to the procedure of Example 12, except that ethylene-vinyl acetate copolymer (DENKA Evatex, produced by DENKIKAGAKU KOGYO Co., Ltd., ethylene/vinyl acetate≈2/8, solid content: 55%) was employed as the adhesive substance.

EXAMPLE 17

A toner was prepared according to the procedure of Example 13 wherein encapsulation of the adhesive substance was effected with a urea-formaldehyde resin and the ratio of adhesive substance to urea-formaldehyde resin was set to be 10/1.

EXAMPLE 18

A toner was prepared according to the procedure of Example 17 wherein styrene-butadiene copolymer emulsion (JSR #0602, produced by NIPPON GOSEI GOMU Co., solid content: 50%) was employed as a binder.

EXAMPLE 19

One hundred and twenty parts by weight of 2-ethylhexyl acrylate, 60 parts by weight of vinyl propionate, 10 parts by weight of acrylic acid and 10 parts by weight of butyl oleate were emulsion polymerized to obtain an adhesive substance emulsion whose solid content was 50%. To 70 grams of this emulsion were added, as a tackifier, 30 grams of polyolefin resin emulsion (Picopale A-20, produced by ESSO STANDARD OIL Co., Ltd.). This mixture was added to 200 grams of an encapsulating aqueous solution containing dissolved therein 5 grams of gum arabic and 5 grams of gelatin, and the mixed particles of adhesive substance and tackifier were encapsulated by means of the complex coacervation method.

Separately, a dispersion was prepared by dispersing 100 parts by weight of magnetic powder and 5 parts of weight of carbon black in a styrene resin dispersion (Dow Plastic Pigment #722, produced by DOW CHEMICAL Co., solid content: 50%). This dispersion was uniformly admixed with said liquid containing encapsulated adhesive substance and tackifier, and finally same was subjected to spray-drying by means of a NIRO atomizer, whereby a magnetic-type, pressure sensitive adhesive toner for use in electrostatic photography was obtained which comprises porous aggregates of capsules, containing a mixture of adhesive substance and tackifier as core material, with magnetic powder.

EXAMPLE 20

In place of the adhesive substance emulsion of Example 19 there was prepared an emulsified polymer (solid content: 50%) having a resin composition consisting of 70 parts by weight of 2-ethylhexyl acrylate, 28 parts by weight of vinyl acetate, 2 parts by weight of arcylic acid and 5 parts by weight of glyceryl monostearate. 50 grams of this emulsified polymer were mixed with a tackifier, i.e., rosin ester emulsion (SE-50, produced by ARAKAWA RINSAN KAGAKU Co., Ltd., solid content: 50%). This mixture was subjected to the procedure of Example 19 thereby to obtain a magnetic-type, pressure sensitive adhesive toner for use in electrostatic photography.

EXAMPLE 21

The adhesive substance and tackifier of Example 19 were separately encapsulated. Then 55 grams, calculated as the solids, of said encapsulated adhesive substance, 33 grams, calculated as the solids, of said encapsulated tackifier, 18 grams of carbon black and 88 grams of polystyrene dispersion (Dow Plastic Pigment #722, produced by DOW CHEMICAL CO., solid content: 50%) were dispersed, and this dispersion was finally subjected to spray-drying thus to obtain a non-magnetic type, pressure sensitive adhesive toner.

EXAMPLE 22

A pressure sensitive adhesive toner was prepared according to the procedure of Example 19 wherein Picopale emulsion was employed as adhesive substance in place of the emulsion of carnauba wax, i.e., Serozol #524 (produced by CHYUKYO YUSHI Co., solid content: 50%).

Comparative experiments were carried out in order to compare the toners of the present invention with those obtained according to examples disclosed in Japanese Open Pat. Application Nos. 75032/1973 and 17739/1974. Comparative Example 1.

A toner was prepared according to the procedure of Example 6 disclosed in Japanese Open Pat. Application No. 75032/1973. In particular, a mixed resin solution was prepared by dissolving 24 grams of polystyrene (PS-2, produced by DOW CHEMICAL CO., U.S.A.) and 24 grams of a phenol-formaldehyde resin (ERLB-0449, produced by UNION CARBIDE Co., U.S.A.) in 450 grams of a chloroform-cyclohexene mixed solvent (volume ratio 4:3). To this solution was added 2.5 grams of carbon black (Peerless 155, produced by COLUMBIA CARBON Co., U.S.A.) and same was uniformly dispersed in the solution by means of a homomixer. Next, this dispersion was subjected to spray-drying by using a NIRO atomizer under the following spray-drying conditions: inlet temperature 68° C., outlet temperature 53° C. and spraying pressure 6 Kg/cm$^2$.

The thus obtained toner particles, which were apt to cohere to each other, were dried under reduced pressure in a vacuum drier for 24 hours thereby to remove the residual solvent, and then the toner particles were admixed with 0.5% by weight of hydrophobic silica (Aerosil) in order to improve the flowability, whereby to obtain final toner particles. Comparative Example 2

A toner was prepared according to the procedure disclosed in Japanese Open Pat. Application No. 17739/1974. In particular, according to the procedure of Example VI of said application, a mixed resin solution was prepared by dissolving 24 grams of polystyrene (PS-2, produced by DOW CHEMICAL CO., U.S.A.) and 24 grams of a phenol-formaldehyde resin (ERLB-0449, produced by UNION CARBIDE CO., U.S.A.) in 450 grams of a chloroform-cyclohexene mixed solvent (volume ratio 4:3). To this solution was added 2.5 grams of carbon black (Peerless 155, produced by COLUMBIA CARBON Co., U.S.A.) and 5 grams of super-microcrystalline powder of a nickel-iron-cobalt alloy (produced by Vacuum Metallurgical Co., Ltd.) and same was fully dispersed in the liquid by means of a homomixer. Next, this dispersion was subjected to spray-drying by using a NIRO atomizer under the spray-drying conditions: rate of liquid supply 200 ml/min., inlet temperature of air for drying 76° C., outlet temperature 76° C., and spraying pressure 5 Kg/cm$^2$, thus to obtain a control toner.

Electrostatic latent images were developed by using the control toners thus obtained and those disclosed in the Examples of the present invention. The developed images were passed between a pair of pressure fixing rollers to fix the toner on the substrate.

The properties of the toners and the properties of the developed images made therefrom were measured. The results shown in the following table were obtained.

| Sample | Particle size distribution of toner (μm) Mean particle size | Standard deviation | Pressure fixability (Kg/mm) | Flow-ability | Image density |
|---|---|---|---|---|---|
| Comparative Example 1 | 13.8 | 1.63 | 7.5 | Δ | 0.98 |
| Comparative Example 2 | 13.6 | 1.64 | 7.8 | x | 0.92 |
| Example 8 | 16.8 | 1.76 | 3.0 | o | 1.19 |
| Example 10 | 15.3 | 1.64 | 1.9 | o | 1.23 |
| Example 11 | 17.2 | 1.70 | 1.5 | o | 1.12 |
| Example 12 | 17.3 | 1.72 | 1.5 | o | 1.18 |
| Example 15 | 16.9 | 1.70 | 1.2 | Δ | 1.10 |
| Example 19 | 16.6 | 1.75 | 1.9 | o | 1.19 |
| Example 20 | 15.8 | 1.62 | 1.9 | o | 1.20 |
| Example 21 | 16.4 | 1.73 | 1.2 | o | 1.14 |
| Example 22 | 17.0 | 1.75 | 1.9 | o | 1.22 |

Notes:

1. Pressure fixability was measured as follows: Pressure sensitive cellophane tapes were adhered onto developed fixed images obtained by passing substrates between the fixing rollers, using various fixing pressures. Then the pressure sensitive cellophane tapes were stripped off the substrate and the tapes were examined to determine whether or not the toner image had been transferred to the tape. The pressure fixability referred to in the table is the fixing pressure that is required in order to form fixed images that do not transfer to the tape.

2. The image density was measured after fixation by using a MACBETH densitometer.

3. Flowability is the result obtained by measurement of the condition of the toner during use in a developing apparatus, wherein "o" indicates that the toner can be uniformly applied without causing any blur in developing, "Δ" indicates that toner cannot be uniformly supplied without the aid of light vibration, and "x" indicates that the toner cannot be uniformly supplied, even when vibrated, due to marked cohesion of the toner particles.

As described above, the toners used in the present invention are superior in fixability and other toner characteristics. Further, the present invention, particularly in the cases of Examples 8 to 22 wherein the pressure sensitive adhesive substances having a relatively small particle size are encapsulated as core materials, is featured in that toners having an optional particle size can be readily prepared by controlling the conditions during spray-drying. Further, the present invention makes it possible to readily control the rupture pressure and adhesive properties of toners by varying the volume ratio of the components. Still further, the method of preparing toners according to the present invention is advantageous in that because it is carried out in an aqueous solvent, there is little danger of fire and environmental pollution and it also is easy to perform. It is mentioned that in the examples of preparing toners of the present invention, coloring agents and/or magnetic particles are dispersed in a pressure sensitive adhesive substance or a binder. It is readily contemplated, however, that said coloring agents and/or magnetic particles may be added to the encapsulating material, or to the binder or to the core material, or it may be added to all of these components. For instance, when coloring agents and/or magnetic particles are dispersed in an aqueous solution of encapsulating material, a binder latex capable of forming a hydrophobic high molecular film, or both, the resulting toners contain said coloring agents and/or magnetic particles in the capsule wall, the material bound or coated after spray-drying, or the capsule wall and hydrophobic high molecular film, respectively.

The present invention provides a pressure fixable toner, but it should be noted that the toner is not limited to pressure fixing alone. If the toner is heated to a certain extent and then is subjected to pressure fixing, further improvement in fixing efficiency can be obtained.

The embodiments of the invention in which an exclusive property or privilege is claimed are defined as follows:

1. A pressure-sensitive adhesive toner for use in electrostatic photography consisting essentially of porous particles having a mean particle size of about 5 to 30 microns, each of said porous particles consisting essentially of a cluster of a plurality of granules wherein each of said granules has a core of pressure-sensitive adhesive substance encapsulated by a thin coating film of encapsulating material, said pressure-sensitive adhesive substance being solid at room temperature, having a modulus of elasticity of less than $10^{10}$ dyne/cm$^2$ and a blocking-initiating temperature of lower than 50° C., said encapsulating material having a blocking-initiating temperature of higher than 50° C., said granules being adhered together to form said porous particle, said granules also containing a material selected from the group consisting of inorganic pigment particles, organic pigment particles, magnetic particles and mixture thereof, said toner having been prepared by spray-drying an aqueous dispersion of said granules containing said material, whereby said toner can be fixed by mechanically pressing and thereby breaking said porous particles.

2. A toner as claimed in claim 1 in which said granules also contain a film-forming binder, said binder having been supplied by incorporating an aqueous emulsion or latex of said binder in said aqueous dispersion prior to said spray-drying.

3. A toner as claimed in claim 2 in which said binder is selected from the group consisting of styrene-butadiene copolymer, carboxy modified styrene-butadiene copolymer, acrylonitrile-butadiene copolymer, carboxy modified acrylonitrile-butadiene copolymer, methylmethacrylate-butadiene copolymer, carboxy modified methylmethacrylate-butadiene copolymer, arcylic acid ester type copolymer, methacrylic acid ester type copolymer, ethylene-vinyl-acetate copolymer, and ethylene-vinyl alkyl ether copolymer.

4. A toner as claimed in claim 1 in which said material consists of said inorganic pigment or organic pigment.

5. A toner as claimed in claim 1 in which said material consists of said magnetic substance.

6. A toner as claimed in claim 1 in which said material consists of a mixture of said inorganic pigment or organic pigment and said magnetic substance.

7. A toner according to claim 1 wherein the ratio of said pressure sensitive adhesive substance to said material is in the range of about 1/20 to 20/1 parts by weight.

8. A toner according to claim 1 wherein said porous particles have a porosity of about 5 to 50% and a true specific gravity of about 0.9 to 2.9.

9. A toner according to claim 8 wherein the pressure sensitive adhesive substance is selected from the group consisting of the following (1) to (7), (1) a copolymer of at least one monomer selected from the following Monomer Group A and at least one monomer selected from the following Monomer Group B or a copolymer of at least one monomer selected from the Monomer Group A, at least one monomer selected from the Monomer Group B and at least one monomer selected from the following Monomer Group C, Monomer Group A:

ethyl, butyl, isoamyl and 2-ethylhexyl esters of acrylic acid; ethyl, butyl, isoamyl, 2-ethylhexyl and lauryl esters of methacrylic acid; dioctyl maleate and dioctyl fumarate Monomer Group B:

methyl acrylate, methyl methacrylate, acrylonitrile, styrene, vinyl acetate and vinyl propionate Monomer Group C:

acrylic acid, methacrylic acid, hydroxy ethyl methacrylate, hydroxy propyl methacrylate, methylol acrylamide, acrylamide, dimethylaminomethyl methacrylate, diethylaminoethyl methacrylate, glycidyl methacrylate and itaconic acid (2) isobutylene rubber, polybutene, butadiene rubber, nitrile rubber, natural rubber and chlorinated rubber, and copolymers and graft copolymers of said rubbers and acrylic monomers (3) rosin, dammar, copal, hydrogenated rosin, rosin ester, indene resin, cumarone resin, polyolefinic resin, polyterpene and alkyd resin (4) dioctyl phthalate, dibutyl phthalate and chlorinated paraffin (5) stearic acid, palmitic acid, myristic acid, lauric acid, aluminum stearate, potassium stearate, zinc palmitate, hydrogenated castor oil, cocao butter, methylhydroxy stearate, glycerol monohydroxy stearate, Japan wax, beeswax, carnauba wax, microcrystalline wax, paraffin wax, low molecular weight polyethylene and low molecular weight ethylene-vinyl acetate copolymers (6) epoxy modified phenol resin, natural resin modified phenol resin, amino resin, silicone resin, polyurethane, urea resin and polyester (7) asphalt and gilsonite.

10. A toner according to claim 9 wherein said encapsulating material is at least one material selected from the group consisting of gum arabic, gelatin, albumin, sodium alginate, carboxymethyl cellulose, hydroxyethyl cellulose, ethylene-anhydrous sodium maleate copolymer, vinyl methyl ether-maleic anhydride copolymer, vinyl methyl ether-maleic anhydride ester copolymer, styrene-acrylic acid-butyl methacrylate copolymer, urea-formaldehyde polycondensate, polyester and polyamide.

11. A pressure-sensitive adhesive toner for use in electrostatic photography consisting essentially of approximately spherical porous particles having a rough surface, a mean particle size of about 5 to 30 microns, a porosity of about 5 to 50% and a specific gravity of about 0.9 to 2.9, each of said porous particles consisting essentially of a cluster of a multiplicity of individual granules wherein each of said granules has a core of pressure-sensitive adhesive substance encapsulated by a thin frangible coating film of encapsulating material, said pressure-sensitive adhesive substance being solid at room temperature, having a modules of elasticity of less than $10^{10}$ dyne/cm$^2$ and a blocking-initiating temperature of lower than 50° C., said encapsulating material having a blocking-initiating temperature of higher than 50° C., the surfaces of said granules being adhered together at the locations where they contact each other with spaces being formed where said granules are not in contact with each other whereby said porous particle is unitary and shape-retaining but is crushable when a fixing pressure is applied thereon, said porous particle having a material selected from the group consisting of inorganic pigment particles, organic pigment particles, magnetic particles and mixture thereof randomly dispersed in said spaces and adhered to the encapsulating films of said granules, the ratio of said pressure-sensitive adhesive substance to said material being in the range of 1/20 to 20/1 parts by weight, said toner having been prepared by spray-drying an aqueous dispersion of said granules containing said material, whereby said toner can be fixed by mechanically pressing and thereby breaking said porous particles into separate granules and the encapsulating films of said granules are also broken to release said pressure-sensitive adhesive, said pressure-sensitive adhesive substance being selected from the group consisting of the following (1) to (7), (1) a copolymer of at least one monomer selected from the following Monomer Group A and at least one monomer selected from the following Monomer Group B or a copolymer of at least one monomer selected from the Monomer Group A, at least one monomer selected from the Monomer Group B and at least one monomer selected from the following Monomer Group C, Monomer Group A:

ethyl, butyl, isoamyl and 2-ethylhexyl esters of acrylic acid, ethyl, butyl, isoamyl, 2-ethylhexyl and lauryl esters of methacrylic acid; dioctyl maleate and dioctyl fumarate Monomer Group B:

methyl acrylate, methyl methacrylate, acrylonitrile, styrene, vinyl acetate and vinyl propionate Monomer Group C:

arcylic acid, methacrylic acid, hydroxy ethyl methacrylate, hydroxy propyl methacrylate, methylol acrylamide, acrylamide, dimethylaminomethyl methacrylate, diethylaminoethyl methacrylate, glycidyl methacrylate and itaconic acid (2) isobutylene rubber, polybutene, butadiene rubber, nitrile rubber, natural rubber and chlorinated rubber, and copolymers and graft copolymers of said rubbers and acrylic monomers (3) rosin, dammar, copal, hydrogenated rosin, rosin ester, indene resin, cumarone resin, polyolefinic resin, polyterpene and alkyd resin (4) dioctyl phthalate, dibutyl phthalate and chlorinated paraffin (5) stearic acid, palmitic acid, myristic acid, lauric acid, aluminum stearate, potassium stearate, zinc palmitate, hydrogenated caster oil, cocao butter, methylhydroxy stearate, glycerol monohydroxy stearate, Japan wax, beeswax, carnauba wax, microcrystalline wax, paraffin wax, low molecular weight polyethylene and low molecular weight ethylene-vinyl acetate copolymers (6) epoxy modified phenol resin, natural resin modified phenol resin, amino resin, silicone resin, polyurethane, urea resin and polyester (7) asphalt and gilsonite, and said encapsulating material being at least one material selected from the group consisting of gum arabic, gelatin, albumin, sodium alginate, carboxymethyl cellulose, hydroxyethyl cellulose, ethylene-anhydrous sodium maleate copolymer, vinyl methyl ether-maleic anhydride copolymer, vinyl methyl ether-maleic anhydride ester copolymer, styrene-acrylic acid-butyl methacrylate copolymer, urea-formaldehyde polycondensate, polyester and polyamide.

* * * * *